US007604324B2

(12) United States Patent
Takata et al.

(10) Patent No.: US 7,604,324 B2
(45) Date of Patent: Oct. 20, 2009

(54) APPARATUS FOR EJECTING DROPLETS

(75) Inventors: Masayuki Takata, Nagoya (JP); Yoichiro Shimizu, Kasugai (JP); Hiromitsu Mizutani, Ichinomiya (JP)

(73) Assignee: Brother Kogyo Kabushiki Kaisha (JP)

( * ) Notice: Subject to any disclaimer, the term of this patent is extended or adjusted under 35 U.S.C. 154(b) by 315 days.

(21) Appl. No.: 11/258,929

(22) Filed: Oct. 27, 2005

(65) Prior Publication Data

US 2006/0087532 A1 Apr. 27, 2006

(30) Foreign Application Priority Data

Oct. 27, 2004 (JP) ..... 2004-312207
Oct. 27, 2004 (JP) ..... 2004-312208

(51) Int. Cl.
*B41J 2/14* (2006.01)

(52) U.S. Cl. ..... 347/50; 347/87; 347/86

(58) Field of Classification Search ..... 347/50, 347/86, 87

See application file for complete search history.

(56) References Cited

U.S. PATENT DOCUMENTS

2003/0090540 A1* 5/2003 Shimizu ..... 347/49

FOREIGN PATENT DOCUMENTS

| | | | |
|---|---|---|---|
| FR | 2782202 | * | 2/2000 |
| JP | 329156 | * | 6/1991 |
| JP | 6286126 | | 10/1994 |
| JP | 2002050232 | | 2/2002 |
| JP | 2002354649 | | 12/2002 |
| JP | 2003063042 | * | 3/2003 |
| JP | 2003291456 | | 10/2003 |

* cited by examiner

*Primary Examiner*—Matthew Luu
*Assistant Examiner*—Henok Legesse
(74) *Attorney, Agent, or Firm*—Banner & Witcoff, Ltd.

(57) ABSTRACT

An apparatus for ejecting droplets is provided with a ejecting head for discharging droplets, an electric circuit board having an electric circuit formed on a surface of the electric circuit board, the electric circuit being connected to the ejecting head, a holder for supporting the ejecting head and the electric circuit board, and a cover that overlaps the surface of the electric circuit board when the cover is fixed to the holder. The apparatus for ejecting droplets is further provided with a seal member that fills a gap formed between a peripheral region of the surface of the electric circuit board and an inner surface of the cover. The seal member effectively prevents droplets mist from penetrating to the electric circuit.

6 Claims, 8 Drawing Sheets

APPARATUS FOR EJECTING DROPLETS

CROSS-REFERENCE TO RELATED APPLICATIONS

This application claims priority to Japanese Patent Applications No. 2004-312207 and No. 2004-312208,filed on Oct. 27, 2004,the contents of which are hereby incorporated by reference into the present application.

BACKGROUND OF THE INVENTION

1. Field of the Invention

The present invention relates to an apparatus for ejecting droplets.

2. Description of the Related Art

The apparatus for ejecting droplets is used in various technical fields. For example, an ink jet printer uses a printing head that ejects ink droplets toward a printing sheet. There is known a machine for forming a printed circuit board by ejecting droplets made of conductive material towards an insulating board. There is also known a machine for coating an adhesive layer by ejecting droplets made of adhesive material towards an object to be adhered. A machine for fabricating a three dimensional model by ejecting molten resin droplets towards the three dimensional model under construction is also known. These machines commonly use the apparatus for ejecting droplets.

An apparatus for ejecting droplets in which an ejecting head and an electric circuit board are combined is disclosed in Japanese Laid-Open Patent Application Publication 2003-63042. The ejecting head and the electric circuit board are connected by means of a cable, and the ejecting head and the electric circuit board are fixed to each other.

In use of the apparatus for ejecting droplets, there is a possibility that liquid droplets reach a point where the cable and the electric circuit board are connected. When the contacting point between the cable and the electric circuit board becomes wet, there is a possibility that the electric circuit will be short-circuited or that smoke will be produced. Accordingly, technology has been proposed which covers the contacting point between the cable and the electric circuit board with a liquid absorbent elastic member. When the apparatus for ejecting droplets is mounted on the machine, the liquid absorbent elastic member will be interposed between the apparatus for ejecting droplets and the machine, and the liquid absorbent elastic member reliably covers the contacting point between the cable and the electric circuit board.

BRIEF SUMMARY OF THE INVENTION

When liquid droplets are discharged from the ejecting head, not only will primary droplets be ejected toward an object, but there will be times in which more microscopic liquid droplets will also be generated to form a cloud, i.e., an mist, that will float.

The mist can pass through even narrow gaps. Because of this, there are times in which the mist generated by the ejecting head in a conventional apparatus for ejecting droplets will reach the electric circuit board covered by the liquid absorbent elastic member. As a result, the mist may adhere to the electric circuit to short the electric circuit, and cause damage of the electric circuit of the apparatus for ejecting droplets.

An object of this invention is to obtain an apparatus for ejecting droplets that can prevent mist that is generated when the ejecting head discharges droplets from adhering to an electric circuit of the apparatus for ejecting droplets.

An apparatus for ejecting droplets of the invention comprises an ejecting head, an electric circuit board, a holder, a cover, and a seal member. The ejecting head discharges droplets. The electric circuit board has an electric circuit formed on a top surface of the electric circuit board. The electric circuit is connected to the ejecting head. The holder supports the ejecting head and the electric circuit board. The holder has an opening. When the cover is fixed to the holder, the cover overlaps the top surface of the electric circuit board. The seal member fills at least a part of a gap formed between a peripheral region of the top surface of the electric circuit board and an inner surface of the cover.

When the cover is fixed to the holder in the aforementioned apparatus for ejecting droplets, the top surface of the electric circuit board will be protected by the cover, and the electric circuit formed on the top surface of the electric circuit board will be sheltered from the mist. Because it is unavoidable that a gap is formed between the inner surface of the cover and the top surface of the electric circuit board, it is possible for the mist to penetrate into the gap, however, because at least a part of the gap is sealed by means of the seal member, the mist will be prevented from penetrating into the gap. The mist can be prevented from adhering to the electric circuit.

A cable is connected to the electric circuit board. The cable is folded within the holder. Because of this, a force that pushes out the electric circuit board from the holder will be applied to the electric circuit board due to the resilient force of the cable. The force applied to the electric circuit board is not uniform, but rather differs depending on a location within the electric circuit board.

In the event that a force that pushes out the electric circuit board is applied from the holder to the electric circuit board, and that force differs depending on the location within the electric circuit board, then when one attempts to uniformly compress the seal member disposed along the periphery of the electric circuit board, a large force must be applied between the cover and holder and the cover and the holder must be fixed with the large force. In this situation, there will be a problem in which the cover and/or the holder may deform. When the cover is deformed, the function of protecting the electric circuit from the mist by means of the cover and the seal member will be damaged. When the holder is deformed, problems will occur in which the position of the ejecting head that is supported by the holder will change, and the discharging direction of the droplets discharged from the ejecting head will shift, and the like.

An additional and optional object of the present invention is to achieve a structure in which a seat member that fills the gap between the cover and the electric circuit board is compressed only the amount needed for shielding by fixing the cover and the holder with a comparatively light force that does not deform the cover and the holder.

An apparatus for ejecting droplets developed for achieving this optinal object for providing the better sealing performance, further comprises a support member, a biasing member, and a local pressing member. The support member is provided within the holder to support a bottom face of the electric circuit board. The biasing member applies a force to the electric circuit board in a direction to separate the electric circuit board from the support member. The local pressing member is formed at an area corresponding to a part of the peripheral region of the electric circuit board. When the cover is fixed to the holder, the local pressing member presses the seal member more tightly at the area where the local pressing member is formed than the rest of the area where the local pressing member is not formed.

When a local pressing member is used, the seal member that fills the gap between the cover and the electric circuit board is compressed only the amount needed for shielding by fixing the cover and the holder with the comparatively light force. The electric circuit board can be protected from the mist at the same time that the discharging direction of the droplets can be maintained in the correctly aimed direction.

DETAILED DESCRIPTION OF THE INVENTION

Next, the best mode for carrying out the invention will be described with reference to the figures. In this embodiment, the present invention is applied to an ink jet head unit. The ink jet head unit is one example of an apparatus for ejecting droplets of the invention. The apparatus for ejecting droplets is not limited to the ink jet head unit. The ink jet head unit uses a printing head or an ink jet head. The printing head or the ink jet head is one example of an ejecting head of the invention. The ejecting head is not limited to the printing head or the ink jet head.

(Primary Structure of the Ink Jet Printer)

Figure 1:
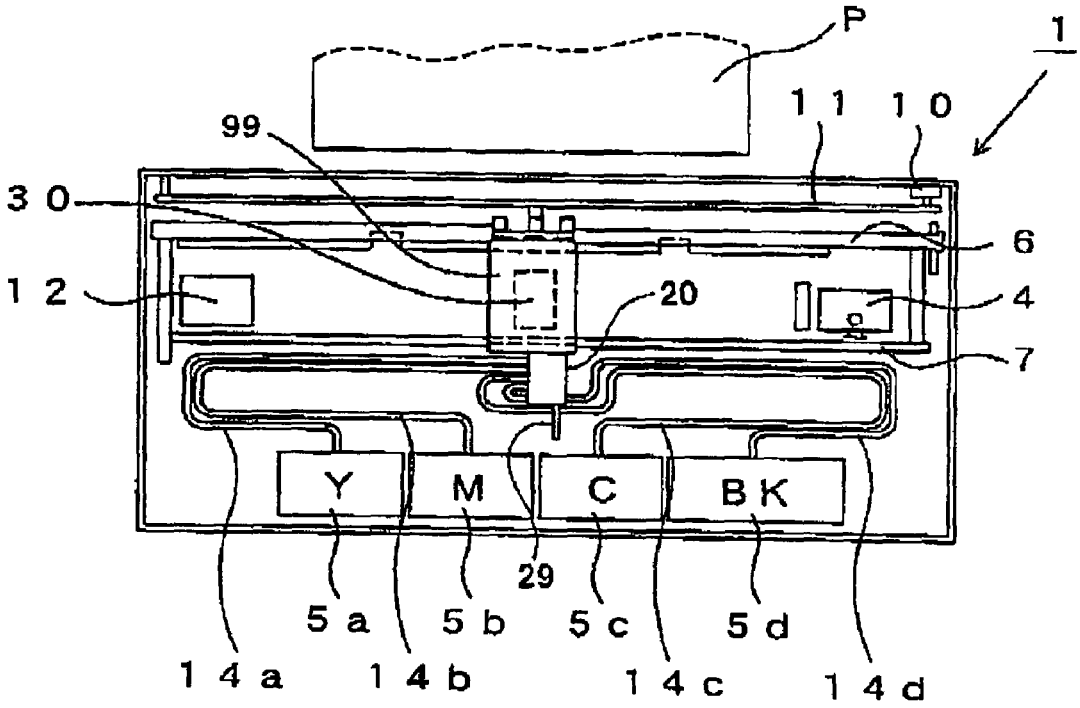
FIG. 1 shows a schematic plan view of an ink jet printer according to the best mode for carrying out the invention.

First, the primary structure of an ink jet printer 1 of this embodiment will be described with reference to FIG. 1. FIG. 1 is a plan view showing the primary structure of the ink jet printer 1.

Two guide shafts 6, 7 are arranged in the interior of the ink jet printer 1, and an ink jet head unit 99 that is also used as a carriage is installed on the guide shafts 6, 7. An ink jet head 30 that discharges ink droplets toward a printing sheet P to perform recording is secured on the ink jet head unit 99. The ink jet head unit 99 is attached to an endless belt 11 that rotates by means of a motor 10. By rotating the motor 10, the ink jet head unit 99 will move along the guide shafts 6, 7. Note that a known timing guide member (not shown in the figures) is provided that extends as a strip along the guide shaft 7, and marks for detecting the position of the ink jet head unit 99 are inscribed on the timing guide member.

The interior of the main unit of the ink jet printer 1 comprises an ink tank 5*a* in which yellow ink is stored, an ink tank 5*b* in which magenta ink is stored, an ink tank 5*c* in which cyan ink is stored, and an ink tank 5*d* in which black ink is stored. Each respective ink tank 5*a*-5*d* is connected with a tube joint 20 of the ink jet head unit 99 by means of flexible tubes 14*a*,14*b*,14*c*, 14*d*. Each ink tank 5*a*-5*d* is stationary in the interior of the ink jet printer 1.

A flushing unit 12 is arranged on one end of the movement direction of the ink jet head unit 99. A maintenance unit 4 is arranged on the other end of the movement direction of the ink jet head unit 99. The ink jet head 30 will discharge undesirable ink that contains air bubbles to the flushing unit 12 in order to maintain the discharge characteristics of the ink in an optimal state. In addition, the maintenance unit 4 will draw in ink that contains air bubbles, wipe a nozzle surface of the ink jet head 30, and maintain the discharge characteristics of the ink in an optimal state.

The printing sheet P is usually paper, but may also be a plastic sheet for use in an OHP, fabric, or the like. When the printing sheet P is a fabric, it may be sewn onto an article of clothing such as a T-shirt in advance.

(Primary Structure of the Ink Jet Head Unit)

Figure 2:
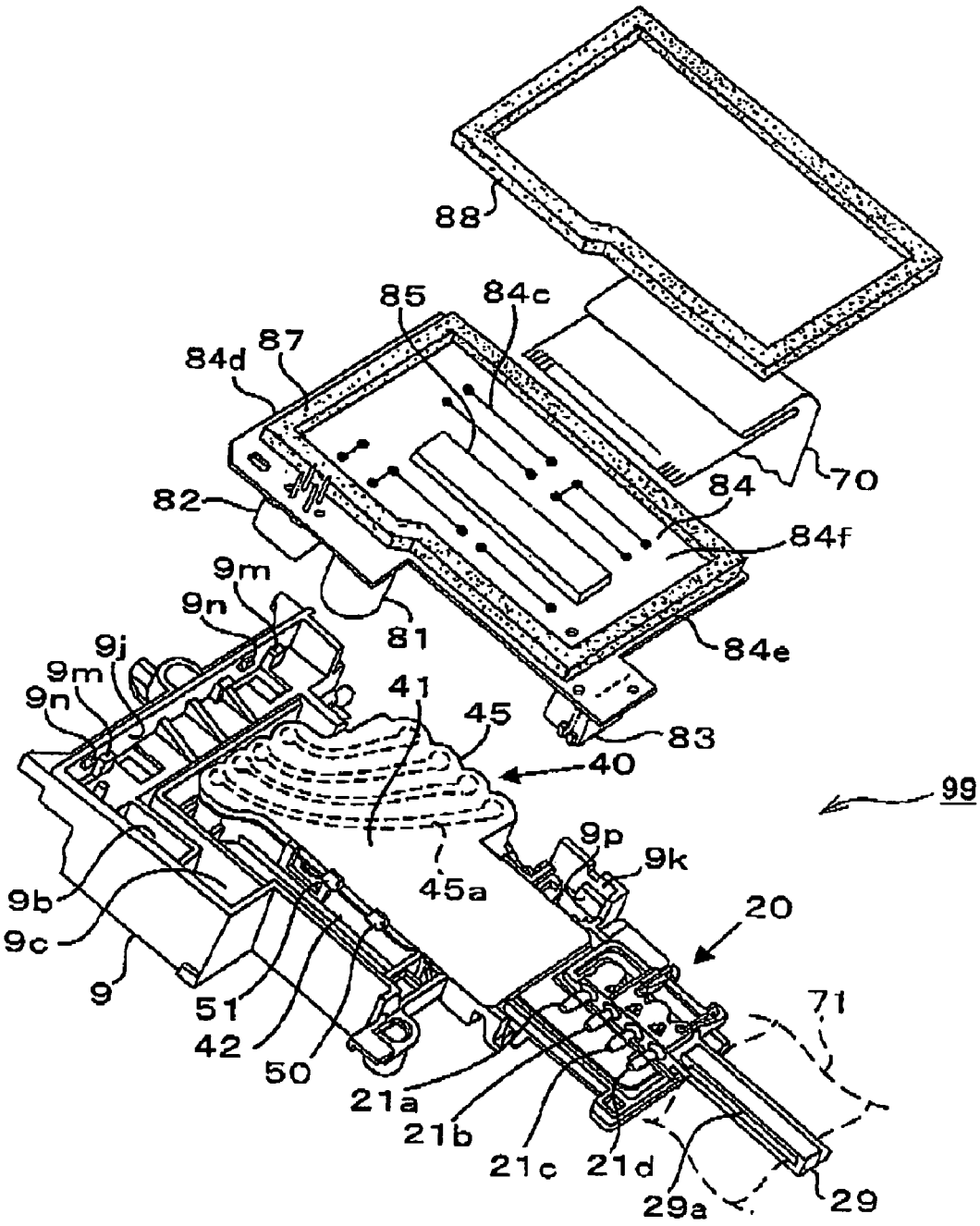
FIG. 2 shows an oblique view of a state in which a cover and an electric circuit board have been removed from an ink jet head unit of the first embodiment.
Figure 3:
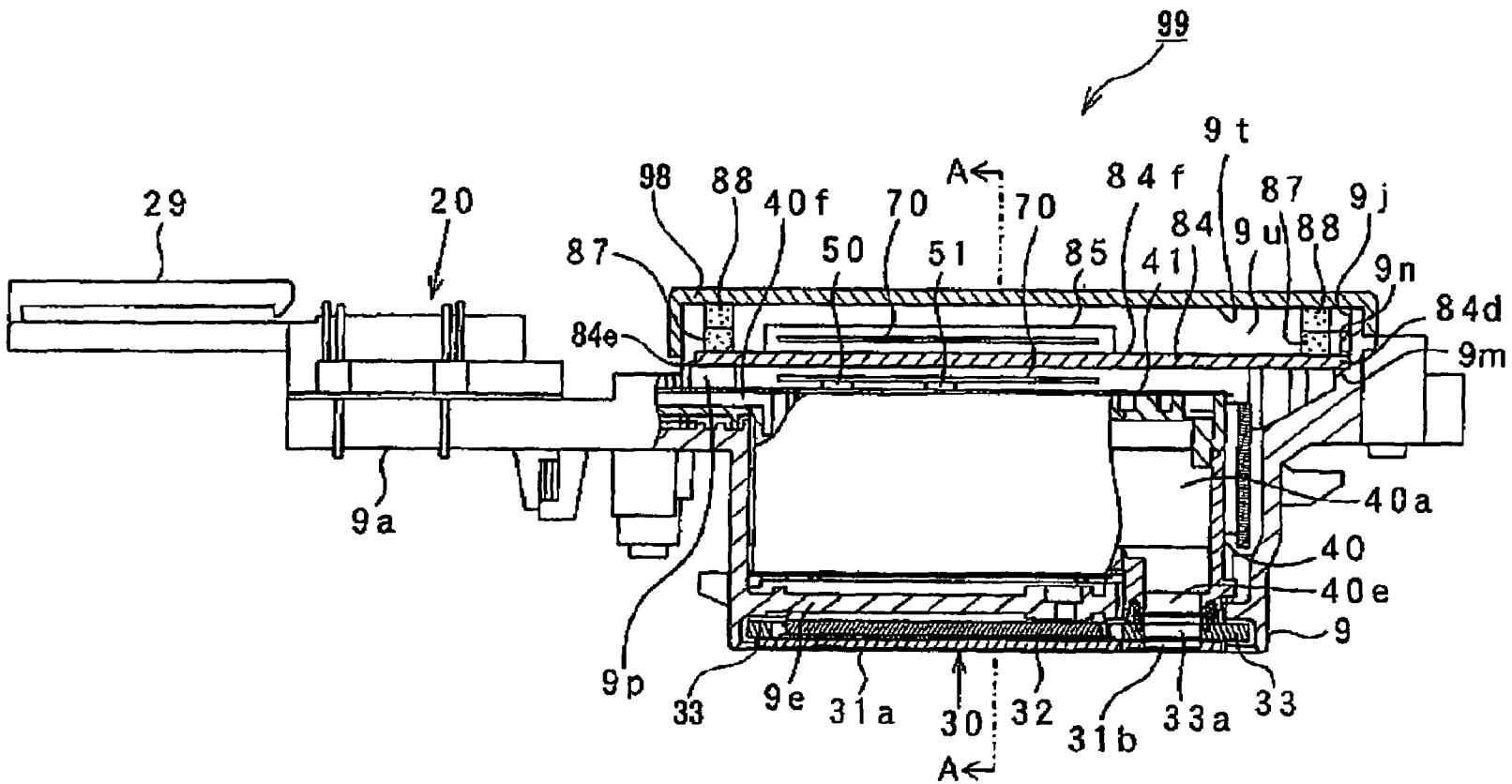
FIG. 3 shows a partial cross-sectional view of the ink jet head unit of the first embodiment.
Figure 4:
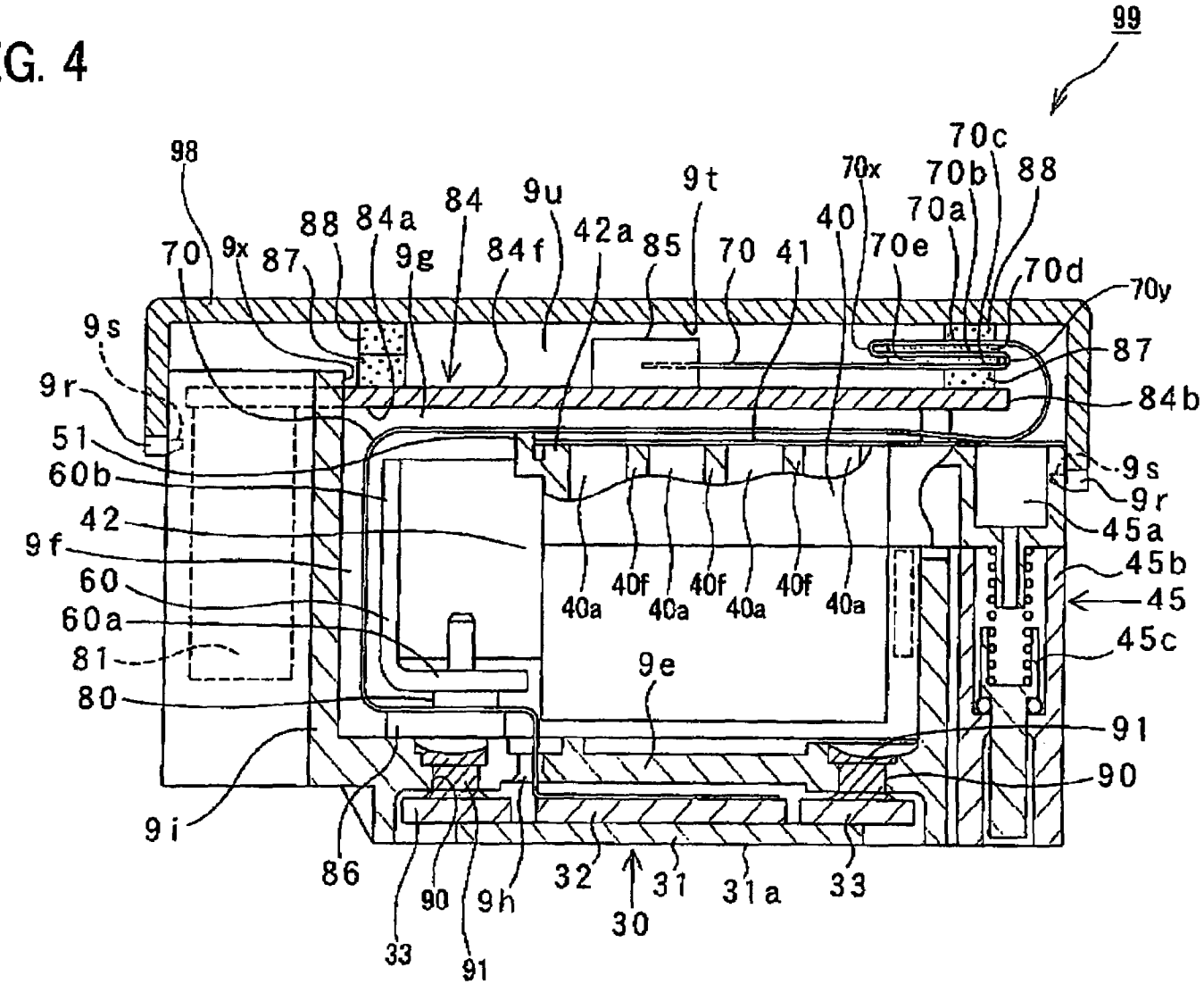
FIG. 4 shows the A-A cross-sectional view of FIG. 3.

Next, the primary structure of the ink jet head unit 99 will be described with reference to FIGS. 2 to 4. FIG. 2 is an oblique view of a state in which an electric circuit board 84 and a cover 98 have been removed from the ink jet head unit 99 (the cover 98 is not shown in FIG. 2, but is shown in FIGS. 3 and 4). FIG. 3 shows a partial cross-sectional view of the ink jet head unit 99. FIG. 4 shows the A-A cross-sectional view of FIG. 3.

Note that in the following description, the side that discharges ink is the lower surface and the downward direction, and the opposite side is the upper surface and the upward direction. In addition, when viewing the lower portion of the ink jet printer 1 in FIG. 1, e.g., from the front, the left end side is the leftward direction, the right end side is the rightward direction, the lower part of the FIG. 1 is the forward direction, and the upper part of the FIG. 1 is the rearward direction.

As shown in FIG. 2, the ink jet head unit 99 comprises a box-shaped holder 9 that is open on the upper surface thereof. As shown in FIG. 3 and FIG. 4, the ink jet head 30 is secured to the lower surface of a bottom wall 9*e* of the holder 9.

As shown in FIG. 4, the ink jet head 30 is a laminated structure composed of a flow path unit 31 having a plurality of ink flow paths, and a piezoelectric actuator unit 32 that selects an ink flow path from the plurality of the ink flow paths and applies a voltage thereto. A plurality of ink discharge nozzles is formed on the lower surface 31*a* of the flow path unit 31. The ink discharge nozzles for each ink color are arranged in a row. Ink flow ports 31*b* (FIG. 3) that are independent for each ink color are formed on the upper surface of the flow path unit 31.

As shown in FIG. 4, a frame-shaped reinforcement frame 33 is adhered and fixed to the upper surface of the ink jet head 30. As shown in FIG. 3, ink channels 33*a* are formed in the reinforcement frame 33. Each ink channel 33*a* corresponds to each ink flow port 31*b*. As shown in FIG. 4, a unit composed of the ink jet head 30 and the reinforcement frame 33 is disposed along the lower surface of the bottom wall 9*e* of the holder 9, and is adhered and fixed to the holder 9 by means of an adhesive 91 that are injected into openings 90 formed through the bottom wall 9*e*.

As shown in FIG. 3, a buffer tank 40 is stored in a space within the holder 9 above the bottom wall 9*e* of the holder 9. Partitions 40*f* (FIG. 4) are formed inside the buffer tank 40, and divide the buffer tank 40 into ink collection chambers 40*a* that are independent for each ink color. An ink supply port 40*e* (FIG. 3) is formed in the lower surface of each ink collection chamber 40*a*. The ink supply port 40*e* for each color of ink communicates with each ink flow port 31*b* via the ink channel 33*a* for each color of ink.

As shown in FIG. 2, the upper surface opening of each ink collection chamber 40*a* (FIG. 3) is covered with a flexible film member 41. More specifically, the film member 41 is constructed of a resin film, and is fixed to the partitions 40*f* that define each ink collection chamber 40*a* (FIG. 4) and the upper ends of the outer peripheral walls of the buffer tank 40 by means of adhesion, ultrasonic welding, or the like. A heretofore predefined quantity of air is stored in the upper portion of each ink collection chamber 40*a* (FIG. 3), and the pressure variations of the ink that accompany the scanning of the ink jet head 30 (FIG. 3) are absorbed by means of the synergy between the air and the flexible film member 41. Air that exceeds the aforementioned predefined quantity is exhausted to the exterior by means of an exhaust device 45 that is arranged on a lateral surface of the buffer tank 40.

As shown in FIG. 4, the exhaust device 45 comprises, for each color, a tubular case 45*b* that communicates via an exhaust channel 45*a* with the air in the upper portion of each ink collection chamber 40*a*. Each tubular case 45*b* comprises a valve 45*c* that opens and closes the flow path in the interior thereof. The lower ends of the tubular cases 45*b* are open in substantially the same plane as the lower surface 31*a* of the ink jet head 30, and when the ink jet head unit 99 has moved to one end of a scan, the valve 45*c* will be opened by means of an operation member not shown in the figures, and air can be discharged from each ink collection chamber 40*a* by connecting a drawing device (not shown) to the lower end openings of the tubular cases 45*b*.

As shown in FIG. 3, an attachment arm 9*a* that extends horizontally forward is integrally formed with the holder 9 on the front end of the ink jet head unit 99. A portion that extends horizontally over the attachment arm 9*a* is formed on the front end of the buffer tank 40, and the extended portion of the buffer tank 40 is configured as a tube joint 20.

Each flexible tube 14*a*-14*d* that extends from each ink tank 5*a*-5*d* is respectively connected to the tube joint 20 by means of tube connection ports 21*a*-21*d* (FIG. 2).

A retaining member 29 is formed to project outward on the front end of the tube joint 20. An electric circuit board 84 described below is electrically connected by means of a flexible flat cable 71 to a control device not shown in the figures that is arranged in a main control unit of the ink jet printer 1. The flexible flat cable 71 is supported by passing it through a slit 29*a* of the retaining member 29 (FIG. 2).

As shown in FIG. 4, an electric circuit board 84 made of a rigid material is disposed along an upper opening 9*x* of the holder 9. More specifically, the electric circuit board 84 is supported on the upper end of a wall that forms the holder 9, and is removably fixed by means of the method described below. A horizontal space 9*g* is provided between the electric circuit board 84 and the buffer tank 40. Furthermore, a cover 98 is fixed so as to cover an upper portion of the electric circuit board 84. The cover 98 is removably fixed to the holder 9. In order to close the opening 9*x* of the holder 9 from the outside, the cover 98 is formed into a box shape that has an opening in the lower portion, and hooks 9*r*, 9*r* that extend toward the inside are formed on the ends of the opening. The hooks 9*r*, 9*r* are engaged in recesses 9*s*, 9*s* that are arranged in positions that correspond to the outer side surfaces of the holder 9. When the hooks 9*r*, 9*r* of the cover 98 are engaged in the recesses 9*s*, 9*s* of the holder 9, the cover 98 will be fixed to the holder 9. At this point, the seal members 87, 88 described below will be compressed between the cover 98 and the electric circuit board 84.

Electric components are attached to the lower spice 84*a* of the left side of the electric circuit board 84 (the left side of FIG. 4) in a state in which they project outward. More specifically, as shown in FIG. 2, a bypass condenser 81, a sheet sensor 82 that detects the presence or absence of the printing sheet P, and an encoder 83 that reads the marks of the strip-shaped timing guide member on the main unit side are suspended from the electric circuit board 84. Accommodation spaces 9*b*, 9*c* that respectively accommodate the bypass condenser 81 and the sheet sensor 82 are formed. When the electric circuit board 84 is attached to the holder 9, the bypass condenser 81 is accommodated in the space 9*c* and the sheet sensor 82 is accommodated in the space 9*b*. The bypass condenser 81 accumulates the electric charge needed to drive an IC chip 80 (FIG. 4).

As shown in FIG. 4, the piezoelectric actuator 32 of the ink jet head 30 is electrically connected to the electric circuit board 84 by means of the flexible flat cable 70. The IC chip 80 is mounted on the flexible flat cable 70. The IC chip 80 converts recording data that was serially transferred from the control device on the ink jet printer main unit to parallel data that corresponds to the ink jet nozzle array not shown in the figures, and also to piezoelectric signals that are suitable for driving the piezoelectric actuator 32.

The flexible flat cable 70 is inserted into the holder 9 through a slit 9*h* that is formed through the bottom wall 9*e* of the holder 9. The flexible flat cable 70 passes through a vertical space 9*f* between a heat sink 60 described below and a lateral wall 9*i* of the holder 9, and a horizontal space 9*g* between the electric circuit board 84 and the buffer tank 40, curves leftward on the right side of the right end 84*b* of the electric circuit board 84, and extends above the electric circuit board 84. The flexible flat cable 70 is folded in two locations, and from above sequentially forms folded portions 70*a*-70*c*. The tip of the flexible flat cable 70 is removably and electrically connected to a connector 85 that is fixed on the top surface 84*f* of the electric circuit board 84.

Here, the folded portion 70*a* and the folded portion 70*b* are adhered and fixed by means of double sided tape 70*d*, and a worker can handle this portion to easily connect the flexible flat cable 70 to the connector 85. After the flexible flat cable 70 is connected to the connector 85, the folded portion 70*b* and the folded portion 70*c* are integrally adhered and fixed by means of double sided tape 70*e*. Note that double sided tape is employed in the present embodiment to perform adhesion, but other fixing means such as an adhesive or the like may also be employed.

The flexible flat cable 70 passes between the cover side seal member 88 and the board side seal member 87 described below. One curved point 70*x* of the flexible flat cable 70 is on the left side of the cover side seal member 88 and the board side seal member 87, and another curved point 70*y* of the flexible flat cable 70 is on the right side of the cover side seal member 88 and the board side seal member 87. The three folded portions 70*a*-70*c* pass between the cover side seat member 88 and the board side seal member 87.

The heat sink 60 is fixed in a position adjacent to the slit 9*h* of the bottom wall 9*e* of the holder 9. The heat sink 60 includes a base 60*a* that is parallel with the bottom wall 9*e*,and a side 60*b* that stands upright therefrom. The IC chip 80 is pressed to the base 60*a* by means of a rubber-like resilient member 86. Heat generated by the IC chip 80 is transmitted to the heat sink 60, and is dissipated from the broad area of the heat sink 60.

An electric circuit 84*c* (FIG. 2) that connects the connector 85, the bypass condenser 81, the sheet sensor 82, and the encoder 83 is formed on the top surface of the electric circuit board 84. The electric circuit board 84 is also connected to the control device on the ink jet printer main unit via a flexible flat cable 71 (FIG. 2).

As shown in FIG. 2, ribs 50, 51 that project upward are arranged on the upper end of the left side wall 42 of the buffer tank 40. The ribs 50, 51 are slightly spaced sideward from the upper end 42*a* of the left side wall 42 of the buffer tank 40, project into the horizontal space 9*g* between the electric circuit board 84 and the film member 41, and are integrally formed with the left side wall 42.

As shown in FIG. 2, support members 9*m*, 9*m* are arranged on an inner face of the rearward wall 9*j* of the holder 9, and serve to contact the bottom surface 84*a* of one end (the rear side end, the first edge) 84*d* of the electric circuit board 84 and support the one end 84*d* of the electric circuit board 84 from below. Retaining projections 9*n*, 9*n* are formed on the left upper side of the support members 9*m*,9*m* and contact the top surface of the electric circuit board 84 to prevent the one end 84*d* of the electric circuit board 84 from moving upward. There is a difference between the heights of the retaining projections 9*n*, 9*n* and the heights of the support members 9*m*, 9*m*, and a gap in which the one end 84*d* of the electric circuit board 84 can be inserted is secured thereby.

A support member 9*p* that serves to support the bottom surface 84*a* of the other end 84*e* (the front side end, the second edge) of the electric circuit board 84 is arranged on the corner of the front side of the lateral wall 9*k* on the right side of the holder 9. The upper surfaces of the support members 9*m*,9*m*, and the upper surface of the support member 9*p*,are arranged so as to be the same height.

The board side seal member 87 that substantially extends along the outer periphery of the electric circuit board 84 is attached to the top surface 84*f* of the electric circuit board 84. The board side seal member 87 extends around the outer periphery of the electric circuit board 84, so as to encircle the electric circuit 84*c*.

As shown in FIG. 3, the cover side seal member 88 that is the same shape as the board side seat member 87 is attached to the inner surface 9*t* of the cover 98, in a position that corresponds to the board side seal member 87. The seal members 87, 88 have a transverse cross section that is square in this embodiment, and have a width that is sufficient to protect the electric circuit 84*c* from the ink mist. In addition, as shown in FIG. 3, when the cover 98 is fixed to the holder 9, the seal members 87, 88 fill a gap 9*u* formed between the inner surface 9*t* of the cover 98 and the top surface 84*f* of the electric circuit board 84. The seal members 87, 88 fill the gap 9*u* formed between the inner surface 9*t* of the cover 98 and the top surface 84*f* of the electric circuit board 84 in the compressed state.

In this embodiment, the seal members 87, 88 are formed with a porous resin having resiliency, and are respectively fixed to the top surface 84*f* of the electric circuit board 84 and the inner surface 9*t* of the cover 98 by means of double sided tape.

As shown in FIG. 4, the electric circuit board 84 is pressed downward via the seal members 87, 88 by means of the cover 9 that closes the opening 9*x* of the holder 9. As shown in FIG. 3, the one end 84*d* of the electric circuit board 84 (the first edge, the right side of FIG. 3) is inserted between the support members 9*m*,9*m* and the retaining projections 9*n*,9*n*. The lower surface 84*a* of the end portion 84*e* of the electric circuit board on the opposite side (the second edge, the left side of FIG. 3) is supported by means of the support member 9*p*.

As shown in FIG. 4, the folded portions 70*a*-70*c* of the flexible flat cable 70 pass between the seal member 87 and the seal member 88, and the seal member 87 and the seal member 88 are adhered to each other around the periphery of the bend portions 70*a*-70*c*.

The material of the aforementioned two seal members 87, 88 is preferably water resistant so as to repel ink, and fire resistant so as to not start a fire when the electric circuit board 84 overheats. In addition, the material is preferably one which has little emitted gas, so as to avoid the occurrence of poor adhesion caused by gas emitted from the seal members 87, 88. Furthermore, in order to maintain a stable reaction force, a material is preferred which rarely creeps, such as for example polyether type polyurethane foam.

The aforementioned two seal members 87, 88 can also be formed on only one of the cover 98 or the board 84. For example, it is possible for only the seal member 88 to be attached to the inner surface 9*t* of the cover 98, the lower surface of the seal member 88 placed into contact with the electric circuit board 84, and then the flexible flat cable 70 placed into contact with the electric circuit board 84. In addition, it is possible for only the seal member 87 to be attached to the electric circuit board 84, the upper surface of the seal member 87 placed into contact with the inner surface 9*t* of the cover 98, and then the flexible flat cable 70 placed into contact with the inner surface 9*t* of the cover 98.

In addition, the flexible flat cable 71 that connects the electric circuit board 84 with the control device on the ink jet printer main unit, can also be protected from the ink mist in the same way as described above and be connected to the electric circuit board 84 by means of one or both of the seal members 87, 88.

[Merits of the Best Mode]

(1) As noted above, if the ink jet head unit 99 of the aforementioned best mode is used, the seal member 87 and the seal member 88 lie within the gap 9*u* between the inner surface 9*t* of the cover 98 and the top surface 84*f* of the electric circuit board 84, and are disposed so as to surround the electric circuit 84*c* formed on the top surface of the electric circuit board 84. Thus, the ink mist can be reliably prevented from penetrating into the interior of the area surrounded by the seal member 87 and the seal member 88, and the ink mist can be prevented from adhering to the electric circuit 84*c*.

(2) Because the cover side seal member 88 is attached to the inner surface 9*t* of the cover 98, gaps between the inner surface 9*t* of the cover 98 and the cover side seal member 88 can be eliminated. Ink mist can be prevented from penetrating from a gap formed between the inner surface 9*t* of the cover 98 and the cover side seal member 88. In addition, the task of attaching the seal member 88 on the inner surface 9*t* of the cover 98 can be performed simply because there is no obstacle thereto such as the electric circuit 84*c*.

(3) Because the board side seal member 87 is attached to the top surface of the electric circuit board 84, gaps between the top surface 84*f* of the electric circuit board 84 and the board side seal member 87 can be eliminated. Ink mist can be prevented from penetrating from a gap formed between the electric circuit board 84 and the seal member 87. In addition, because the board side seal member 87 can be attached so as to surround the periphery of the area where the electric circuit 84*c* is formed, the necessary components can be reliably sheltered.

(4) Because the flexible flat cable 70 passes between the cover side seal member 88 attached to the inner surface 9*t* of the cover 98, and the board side seal member 87 attached to the upper surface 84*f* of the electric circuit board 84, and because the cover side seal member 88 and the board side seal member 87 are in close contact around the periphery of the flexible flat cable 70 in the pass through location, ink mist cam be prevented from penetrating via a gap between the flexible flat cable 70 and the cover side seal member 88 and the board side seal member 87, and can be prevented from adhering to the electric circuit 84*c*.

(5) Because the folded portions 70*a*-70*c* of the flexible flat cable 70 are adhered and fixed to each other by means of double sided tape 70*d*,70*e*,the reaction force that attempts to return the flexible flat cable 70 to the state before it was folded can be suppressed. Thus, there will be no danger that a gap wilt be formed by means of that reaction force between the flexible flat cable 70 and the seal members 87, 88, and ink mist will penetrate from that gap.

In addition, ink mist can be prevented from penetrating from a gap between the folded portions 70*a*-70*c* of the flexible flat cable 70, and adhering to the electric circuit 84*c*.

Furthermore, because there is not need to wait for an adhesive to dry such as when an adhesive is used, the folded portions 70*a*-70*c* can be fixed together in a short period of time.

(6) Because the seal members 87, 88 are resilient members, the ink mist sheltering effect can be improved even more because they can also be adhered to correspond to the recessed portions of the electric circuit board 84, the cover 98, and the flexible flat cable 70.

In addition, because the seal members 87, 88 are porous, it is not necessary to apply an excessive force to deform them, and a moderate reaction force can be obtained in order retain them in the close contact state.

In this embodiment, the present invention is applied to the ink jet head unit. The ink jet head unit is only one example of an apparatus for ejecting droplets of the present invention. The apparatus or ejecting droplets is not limited to the ink jet head unit. The apparatus for ejecting droplets is used in various technical fields. For example, a machine for forming a printed circuit board by ejecting droplets made of conductive material towards an insulating board is known. There is also known a machine for coating an adhesive layer by ejecting droplets made of adhesive material towards an object to be adhered. A machine for fabricating a three dimensional model by ejecting molten resin droplets towards the three dimensional model under construction is also known. These machines commonly use the apparatus for ejecting droplets, and the present invention may be applied to the apparatus for ejecting droplets of various machines.

Other Embodiments (7) The seal members 87, 88 may surround only the necessary area of the electric circuit 84*c*,such as an area where a high voltage is generated. Even when this construction is used, the effects of the best mode noted above can be achieved.

(8) The seal members 87, 88 need not be formed in a continuous shape. For example, when arranged in a row with a predetermined gap, and sandwiched in the compressed state by means of the cover 98 and the holder 9, the gap between adjacent seal members will be filled, and arranged so as to form a ring. Even when this construction is used, the effects of the best mode noted above can be achieved.

(9) An adhesive or the like other than double sided tape may be employed to fix the seal members 87, 88. Even when this construction is used, the effects of the best mode noted above can be achieved.

(10) Another cable other than the flexible flat cable 70 may be employed as the cable that electrically connects the electric circuit 84*c* and the printing head 30, such as for example a lead wire. Even when this construction is used, the effects (1) to (4) and (6) of the best mode noted above can be achieved.

(11) The flexible flat cable 70 is caved inside the holder 9, and urges the electric circuit board 84 upward. The repulsive force of the flexible flat cable 70 will also contribute to bringing the seal members 87, 88 firmly into contact with each other.

(12) The ink jet head unit 99 is also used as a carriage that reciprocates within the ink jet printer. Alternatively, the ink jet head unit 99 may be fixed within the ink jet printer. The present invention may be applied to the ink jet printer with the carriage of serial printing operation, and also may be applied to the ink jet printer with the fixed ink jet head unit of parallel printing operation.

(13) The piezoelectric actuator unit 32 is used for driving the ink jet head 30. Another type actuator may be used for driving the ink jet head 30. For instance an actuator of generating heat or applying electrostatic force may be used as the actuator for driving the ink jet head. The ink droplets may be ejected by heat or electrostatic force.

Second Embodiment

Next, a second embodiment for carrying out this invention will be described with reference to the figures. Only the structure that differs from the first embodiment will be described below, and duplicate disclosures will be omitted.

(Primary Structure of the Ink Jet Head Unit)

Figure 5:
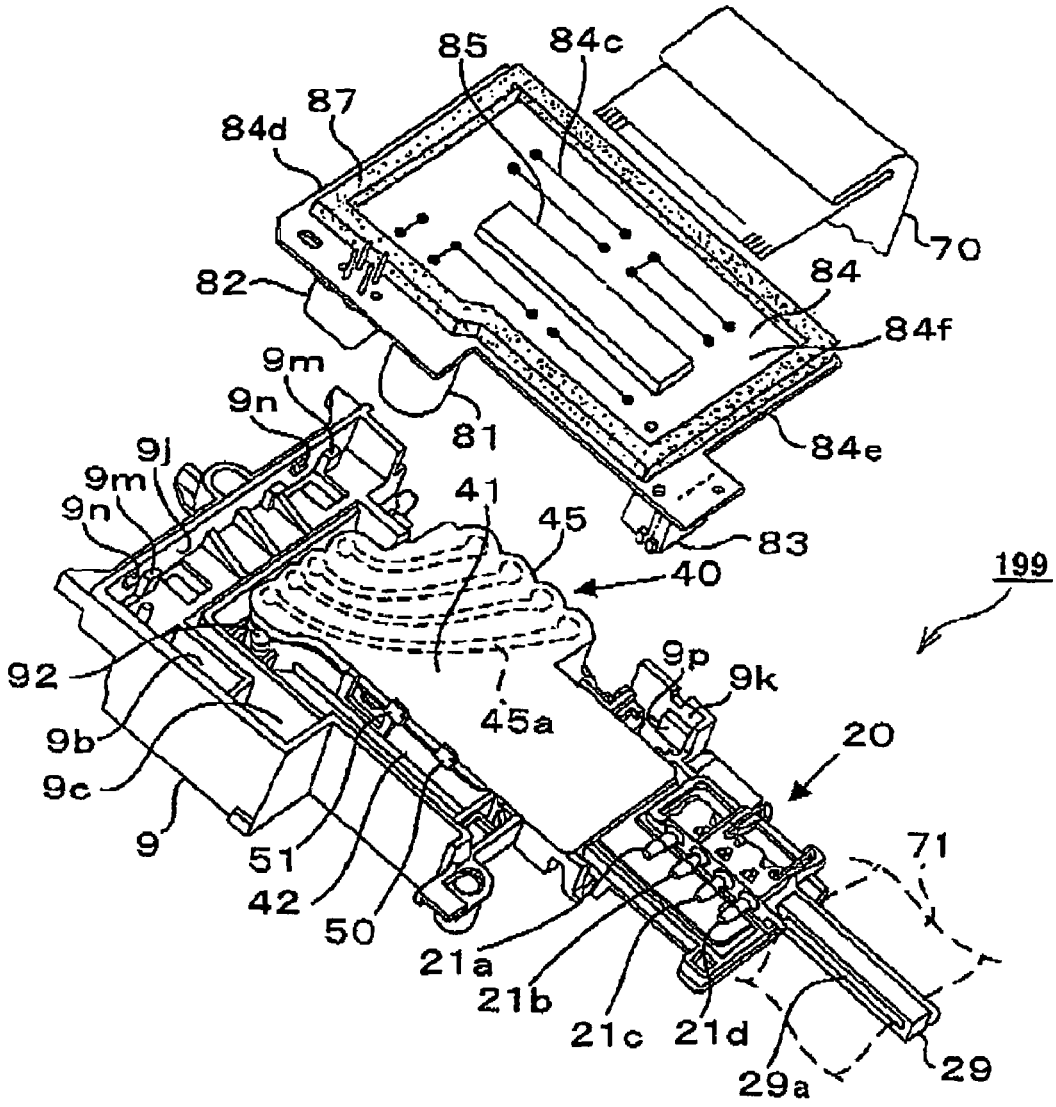
FIG. 5 shows an oblique view of an aspect in which a cover and an electric circuit board have been removed from an ink jet head unit of the second embodiment.
Figure 6:
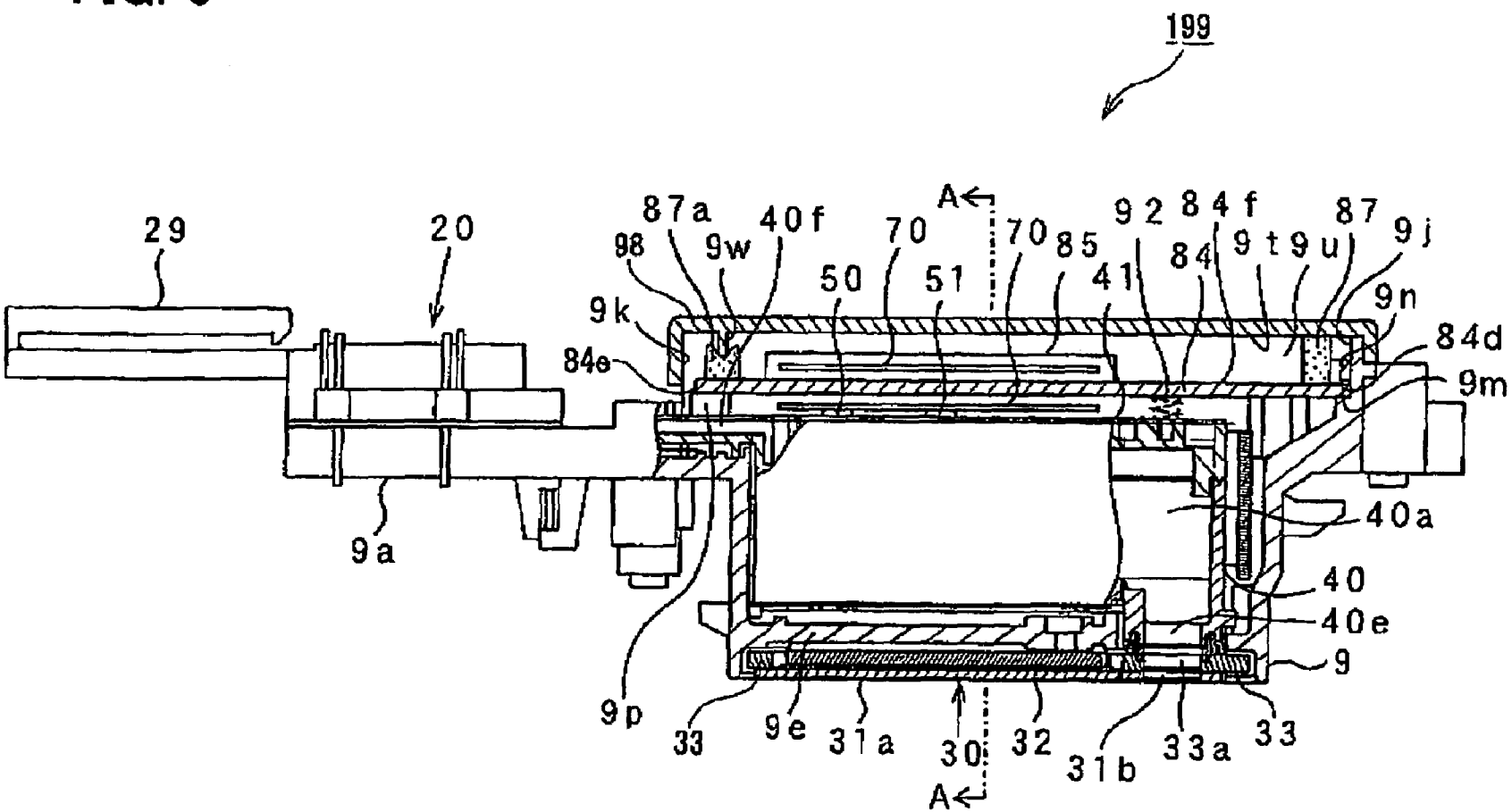
FIG. 6 shows a partial cross-sectional view of the ink jet head unit of the second embodiment.
Figure 7:
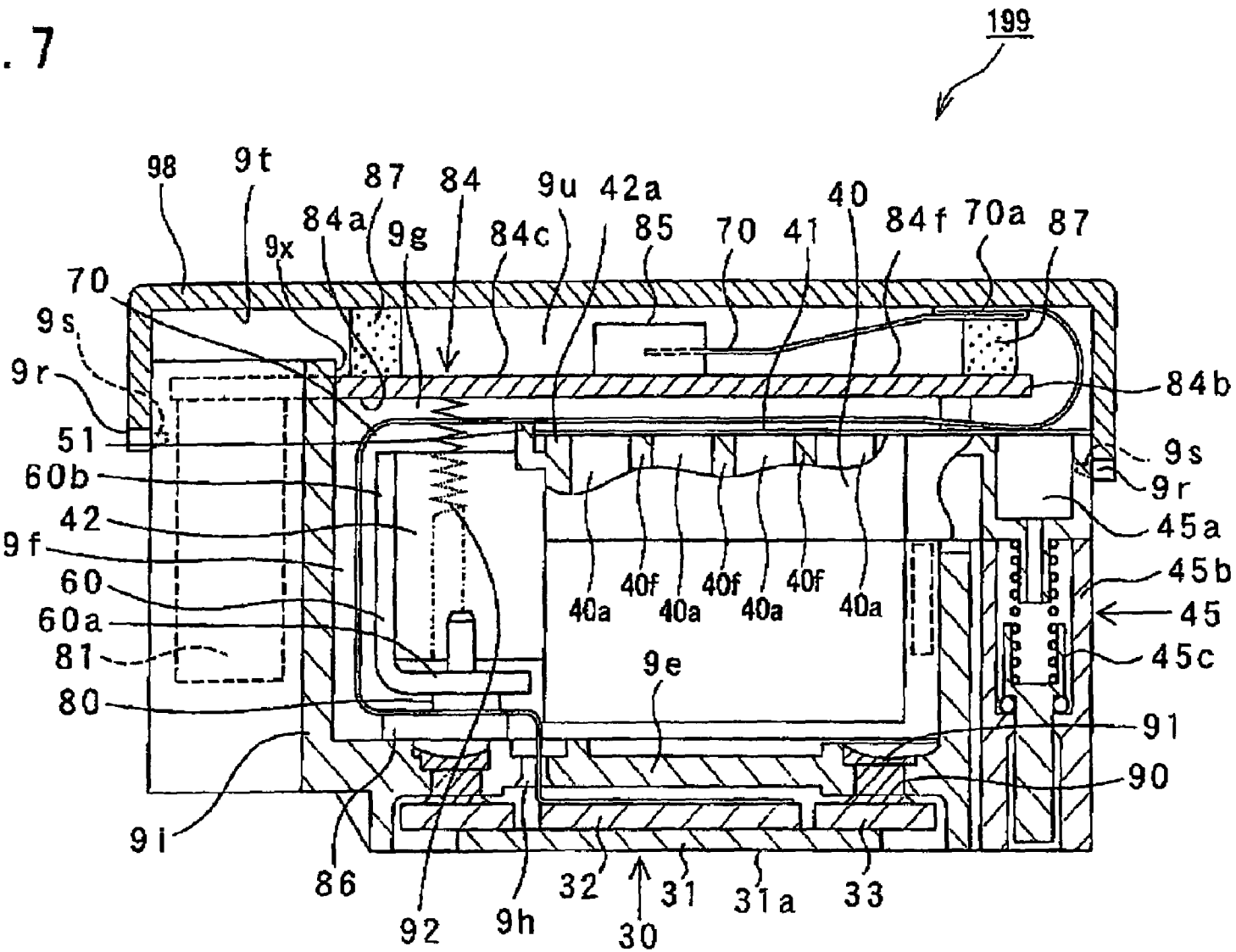
FIG. 7 shows the A-A cross-sectional view of FIG. 6.

FIG. 5 shows an oblique view of the electric circuit board 84 removed from an ink jet head unit 199 of the second embodiment. FIG. 6 shows a cross-sectional view of the ink jet head unit 199. FIG. 7 shows the A-A cross-sectional view of FIG. 6.

As shown in FIG. 5, an annular board side seal member 87 that runs along the outer periphery of the electric circuit board 84 is attached to the upper surface 84*f* of the electric circuit board 84. The board side seal member 87 extends around the area that is formed by the electric circuit 84*c*. The seal member 87 has a transverse cross section that is square, and has a width that is sufficient to protect the electric circuit 84*c* from the ink mist.

As shown in FIG. 6, a cover side seal member is not arranged on the cover 98. In stead, a local pressing member 9*w* that serves to locally and firmly press the seal member 87 is arranged on the cover 98. The local pressing member 9*w* is formed in a bar shape in the left to right direction along the edge of the front side of the board side seal member 87 (the side on which the retaining member 29 is located), and is arranged to be integral with the cover 98. The local pressing member 9*w* projects downward from the cover 98.

As shown in FIG. 5, a coil spring 92 is arranged in a position adjacent to the wall 42 on the left side of the buffer tank 40 that is stored inside the holder 9. The upper end of the coil spring 92 pushes against a ground contact point that is formed on the bottom surface 84*a* of the electric circuit board 84, and the bottom end thereof is fixed to the holder 9. The coil spring 92 urges the electric circuit board 84 upward. The coil spring 92 is formed with a conductive material, and the lower end thereof is electrically connected with a ground terminal of the piezoelectric actuator unit 32. The ground terminal of the piezoelectric actuator unit 32 is grounded by the ground contact point of the electric circuit board 84 by means of the coil spring 92.

As shown in FIG. 6, the seal member 87 is adjusted to a thickness that can be interposed in the compressed state in the gap 9*u* between the inner surface it of the cover 98 and the top surface 84*f* of the electric circuit board 84, and press and fix the electric circuit board 84. In other words, the thickness when the seal member 87 is in its natural shape is set to be thicker than the space of the gap 9*u* formed between the inner surface 9*t* of the cover 98 and the top surface 84*f* of the electric circuit 84 when the cover 98 is fixed to the holder 9.

Because the flexible flat cable 70 is curved and connected in a horizontal U-shape from the horizontal space 9*g* downward from the electric circuit board 84, it urges the electric circuit board 84 upward by means of the resilient force thereof, In addition, the coil spring 92 also urges the electric circuit board 84 upward.

One end 84*d* of the electric circuit board 84 (the end on the rearward side, corresponding to the first edge, the right side in FIG. 6) is inserted between the support members 9*m*,9*m* and the retaining projections 9*n*,9*n*.

Because the electric circuit board 84 pivots around the one end 84*d* inserted between the support member 9*m* and the retaining projection 9*n* as a fulcrum, in order to resist the aforementioned urging force and push downward the other end 84*e* of the electric circuit board 84 (the end on the frontward side, corresponding to the second edge), a pressing force that is comparatively larger than the other portions outside the other end 84*e* of the front side is needed The other end 84*e* side seal member 87*a* is pressed by the local pressing member 9*w*, and thus is more firmly compressed compared to the other portions of the seal member 87 when the cover 9 is placed thereon. As a result, the other end 84*e* side of the electric circuit board 84 is pressed with a pressing force that is larger than the other portions.

When the cover 98 is fixed to the holder 9, the other end 84*e* of the electric circuit board 84 is pushed downward via the local pressing member 9*w* and the seal member 87. The lower surface of the other end 84*e* of the electric circuit board 84 is supported by the support member 9*p*.

The folded portion 70*a* of the flexible-flat cable 70 is vertically sandwiched by means of the seal member 87 and the inner surface 9*t* of the cover 98.

Figure 8:
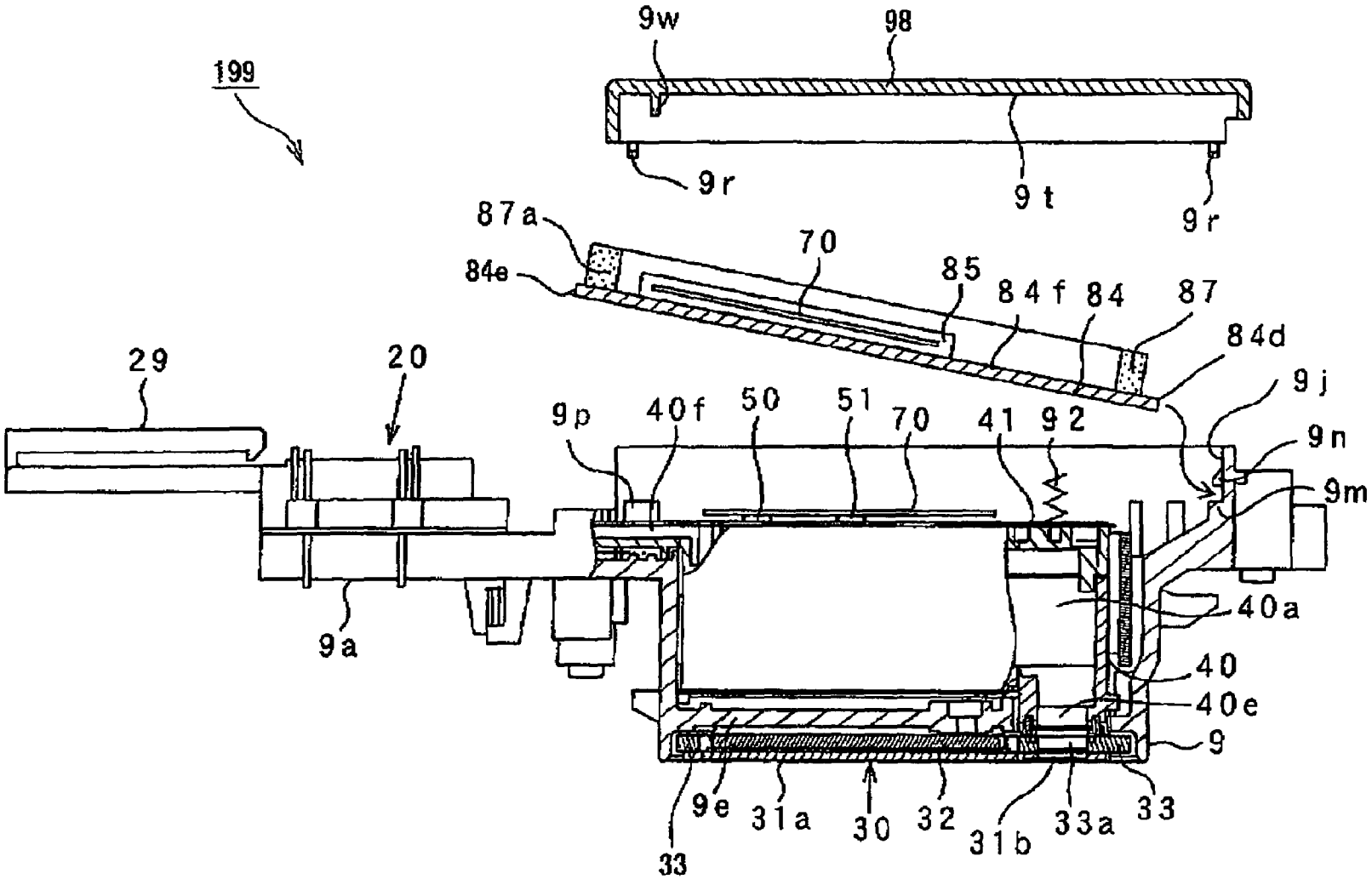
FIG. 8 shows a cross-sectional view of the process of installing an electric circuit board and a cover into a holder of the second embodiment.

The method of fixing the electric circuit board 84 will be described with reference to FIG. 8. FIG. 8 is a partial cross-sectional view showing a method of attaching the electric circuit board 84 to the holder 9.

First, the end (first edge) 84*d* on the rear side of the electric circuit board 84 to which the flexible flat cable 70 is connected will be inserted between the support members 9*m*,9*m* and the retaining projections 9*n*,9*n*.

Next, in order to arrange the folded portion 70*a* of the flexible flat cable 70 on the seal member 87, the cover 98 will be placed thereon from above the electric circuit board 84, and will press the other end 84*e* of the electric circuit board 84 downward via the seal member 87.

Then, the hook 9*r* of the cover 98 will be engaged with the recess 9*s* of the holder 9 (FIG. 7), the seal member 87 will be retained as is in the compressed state, and the cover 98 will be fixed to the holder 9.

[Effects of the Second Best Mode]

(1) As noted above, if the ink jet head unit 199 of the aforementioned best mode is used, the location of the seal member 87 that needs a comparatively large pressing force can be compressed more than other portions thereof by means of the local pressing member 9*w*,and thus even when the electric circuit board 84 is pressed with the entire seal member 87, the electric circuit board 84 can be fixed with a small force, and can be effectively sheltered from ink mist. Thus, because there is no need to firmly compress the aforementioned other portions, deformation of the cover 98 can be prevented by means of the resiliency of the seal member 87, and the ink jet head unit 199 having an accurate ink discharge direction can be achieved.

(2) Because the local pressing member 9*w* is arranged on the support member 9*p* side that corresponds to the other end 84*e* of the electric circuit board 84 that needs a comparatively large pressing force, even when the electric circuit board 84 is pressed with the entire seal member 87, the local pressing member 9*w* can fix the electric circuit board 84 with a small force, and can reliably protect the electric circuit 84*c* from ink mist, because it can compress more firmly than the other portions.

In addition, because the one end 84*d* of the electric circuit board 84 can be inserted between the support portion 9*m* and the retaining projection 9*n*,and the other end 84*e* is supported by the support member 9*p*, the electric circuit board 84 can be accurately fixed in a predetermined position.

(3) Even with a structure in which the electric circuit board 84 is urged in a direction away from the support members 9*m*, 9*p* by means of the curved flexible flat cable 70, if the location of the seal member 87 that needs a comparatively large pressing force is pressed by means of the local pressing member 9*w* in order to resist the urging, the local pressing member 9*w* can fix the electric circuit board 84 with a small force and can reliably protect the electric circuit 84*c* from ink mist more than when the electric circuit board 84 is pressed with the entire seal member 87, because the local pressing member 9*w* can compress more than the other portions.

(4) Even with a structure in which the seal member 87 is annularly disposed between the cover 98 and the electric circuit board 84, and around at least a portion of an area of the electric circuit board 84 on which the electric circuit 84*c* is formed, penetration of ink mist can be reliably prevented because no gaps are formed due to the deformation of the cover 98.

(5) Because the local pressing member 9*w* is integrally arranged on the inner surface 9*t* of the cover 98, the local pressing member will not shift position when the cover 98 is placed, and thus a predetermined location of the seal member 87 can be accurately pressed. In addition, if the local pressing member 9*w* and the cover 98 are integral with each other, a separate structure for a local pressing member will become unnecessary, and thus manufacturing costs can be reduced.

(6) Because the seal member 87 is a porous material, it is not necessary to apply an excessive force to deform it, and a moderate reaction force can be obtained in order to fix the electric circuit board 84. In addition, because the seal member 87 can be adhered so as to also deal with the concave and convex portions of the attachment location, the ink mist sheltering effect can be improved even more.

Other Embodiments (7) A shape other than a bar shape may be employed as the local pressing member. For example, a projecting portion of the inner surface 9*t* of the cover member 98 may be arranged with a predetermined gap in a position that corresponds to a predetermined location of the seal member 87*a*. Even when this construction is used, the effects of the best mode noted above can be achieved.

(8) The local pressing member 9*w* is arranged on the cover 98 in the best mode described above, but a portion of a seal member may be used as a local pressing member. For example, a portion of the seal member 87*a* whose thickness in the vertical direction and/or width in the horizontal direction was increased may be locally formed, and that portion may be used as a local pressing member. When this construction is used, the local pressing member will not shift position during pressing and thus can reliably press a predetermined location of the seal member. In addition, it can be easily produced because it is produce in an integral form. Even when this construction is used, the effects (1) to (4) and (6) of the best mode noted above can be achieved.

(9) The local pressing member may be manufactured as an independent item, and interposed as a spacer between the seal member 87 and the cover 98. For example, a horizontal U-shaped local pressing member may be covered by the seal member 87*a*. Even when this construction is used, the effects (1) to (4) and (6) of the best mode noted above can be achieved.

(10) The seal member 87 need not be formed in a continuous shape. For example, when arranged in a row with a predetermined gap, and sandwiched in the compressed state by means of the cover 98, the gap between adjacent seal members will be filled, and arranged so as to form a ring. Even when this construction is used, the effects of the best mode noted above can be achieved.

(11) A seal member may be arranged an the cover side, and a local pressing member may be arranged on the board side.

What is claimed is:

1. An apparatus for ejecting droplets, comprising: an ejecting head that discharges droplets; an electric circuit board having an electric circuit formed on a surface of the electric circuit board, the electric circuit being connected to the ejecting head; a holder that supports the ejecting head and the electric circuit board, the holder having an opening; a cover that overlaps the surface of the electric circuit board when the cover is fixed to the holder; and a seal member that fills at least a part of a gap formed between a peripheral region of the surface of the electric circuit board and an inner surface of the cover, further comprising: a support member provided within the holder to support an inner face of the electric circuit board; a biasing member that applies a force to the electric circuit board in a direction to separate the electric circuit board from the support member; and a local pressing member formed at an area corresponding to a part of the peripheral region of the electric circuit board, wherein the local pressing member presses the seal member more tightly at the area than the rest of the area when the cover is fixed to the holder.

2. An apparatus for ejecting droplets as defined in claim 1, wherein the support member comprising a first support member for supporting a first edge of the electric circuit board and a second support member for supporting a second edge of the electric circuit board, the apparatus for ejecting droplets further comprising: a retaining projection provided in adjacent to the first support member to form a gap between the first support member and the retaining projection, wherein the gap receives the first edge of the electric circuit board, wherein the local pressing member is formed at a position corresponding to the second edge of the electric circuit board.

3. An apparatus for ejecting droplets as defined in claim 1, further comprising: a cable connecting the electric circuit board and the ejecting head, wherein the cable is bent between the electric circuit board and the ejecting head and applies the force to the electric circuit board in the direction to separate the electric circuit board from the support member.

4. An apparatus for ejecting droplets as defined in claim 1, wherein the local pressing member is integrally formed with the cover.

5. An apparatus for ejecting droplets as defined in claim 1, wherein the local pressing member is integrally formed with the seal member.

6. An apparatus for ejecting droplets, comprising: an ejecting head that discharges droplets; an electric circuit board having an electric circuit formed on a surface of the electric circuit board, the electric circuit being connected to the ejecting head; a holder that supports the ejecting head and the electric circuit board, the holder having an opening; a cover that overlaps the surface of the electric circuit board when the cover is fixed to the holder; and a seal member that fills at least a part of a gap formed between a peripheral region of the surface of the electric circuit board and an inner surface of the cover, wherein the seal member is fixed to the peripheral region of the surface of the electric circuit board, and further comprising: a support member provided within the holder to support an inner face of the electric circuit board; a biasing member that applies a force to the electric circuit board in a direction to separate the electric circuit board from the support member; and a local pressing member formed on the cover at an area corresponding to a part of the peripheral region of the electric circuit board, wherein the local pressing member presses the seal member more tightly at the area than the rest of the area when the cover is fixed to the holder.

* * * * *

UNITED STATES PATENT AND TRADEMARK OFFICE

CERTIFICATE OF CORRECTION

PATENT NO. : 7,604,324 B2
APPLICATION NO. : 11/258929
DATED : October 20, 2009
INVENTOR(S) : Takata et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 317 days.

Signed and Sealed this

Fifth Day of October, 2010

David J. Kappos

David J. Kappos
*Director of the United States Patent and Trademark Office*